US010360789B2

(12) United States Patent
Brown et al.

(10) Patent No.: US 10,360,789 B2
(45) Date of Patent: Jul. 23, 2019

(54) FIRE NOTIFICATION SYSTEM AND TEST METHOD USING TEST JIG THEREFOR

(71) Applicant: HOCHIKI CORPORATION, Tokyo (JP)

(72) Inventors: David Brown, Kent (GB); Manabu Dohi, Tokyo (JP); Kiyoaki Koyama, Tokyo (JP); Hiroyuki Tatsuno, Tokyo (JP); Hiroyuki Kase, Tokyo (JP)

(73) Assignee: HOCHIKI CORPORATION, Tokyo (JP)

( * ) Notice: Subject to any disclaimer, the term of this patent is extended or adjusted under 35 U.S.C. 154(b) by 0 days.

(21) Appl. No.: 15/795,742

(22) Filed: Oct. 27, 2017

(65) Prior Publication Data

US 2018/0075733 A1 Mar. 15, 2018

Related U.S. Application Data

(63) Continuation of application No. PCT/JP2015/067585, filed on Jun. 18, 2015.

(51) Int. Cl.

| | |
|---|---|
| ***G08B 21/00*** | (2006.01) |
| ***G08B 29/14*** | (2006.01) |
| ***G08B 17/103*** | (2006.01) |
| ***G08B 5/38*** | (2006.01) |
| ***G08B 17/117*** | (2006.01) |

(52) U.S. Cl.

CPC ..... *G08B 29/145* (2013.01); *G08B 5/38* (2013.01); *G08B 17/103* (2013.01); *G08B 17/117* (2013.01)

(58) Field of Classification Search

CPC ..... G08B 17/103; G08B 29/145; G08B 5/38

USPC ..... 340/514

See application file for complete search history.

(56) References Cited

U.S. PATENT DOCUMENTS

| | | | | |
|---|---|---|---|---|
| 5,497,009 A * | 3/1996 | Torikoshi | G08B 29/145 250/574 |
| 5,552,765 A * | 9/1996 | Vane | G08B 29/145 340/515 |
| 8,466,800 B1 * | 6/2013 | Billman | G08B 29/145 340/500 |

(Continued)

FOREIGN PATENT DOCUMENTS

| | | |
|---|---|---|
| JP | 11-312286 | 11/1999 |
| JP | 2006-268119 | 10/2006 |

*Primary Examiner* — Mark S Rushing

(74) *Attorney, Agent, or Firm* — Wenderoth, Lind & Ponack, L.L.P.

(57) ABSTRACT

A composite fire detector (12) which senses a heat temperature, smoke concentration, and gas concentration due to fire is connected to a transmission path (16) drawn from a fire receiver (10). When a fire test operation is sensed by the fire receiver, a test mode is set to the fire detector. The fire detector performs display control over alarm indicating lights in a mutually varied manner corresponding to each alarm test when a test jig is used to conduct an alarm test by sensing of a heat temperature, an alarm test by sensing of a smoke concentration, and an alarm test by sensing of a gas concentration in a state where the test mode is set. For example, the fire detector repeats one-time blinking of the alarm indicating lights for heat sensing, two-time blinking for smoke sensing, and three-time blinking for gas sensing at intervals of a predetermined nonoperating period.

14 Claims, 11 Drawing Sheets

(56) References Cited

U.S. PATENT DOCUMENTS

| | | | | |
|---|---|---|---|---|
| 2002/0044061 | A1* | 4/2002 | Johnston | G01N 33/004 340/628 |
| 2003/0058093 | A1* | 3/2003 | Dohi | G08B 17/00 340/506 |
| 2004/0257235 | A1* | 12/2004 | Right | G08B 29/145 340/628 |

* cited by examiner

[FIG. 1]
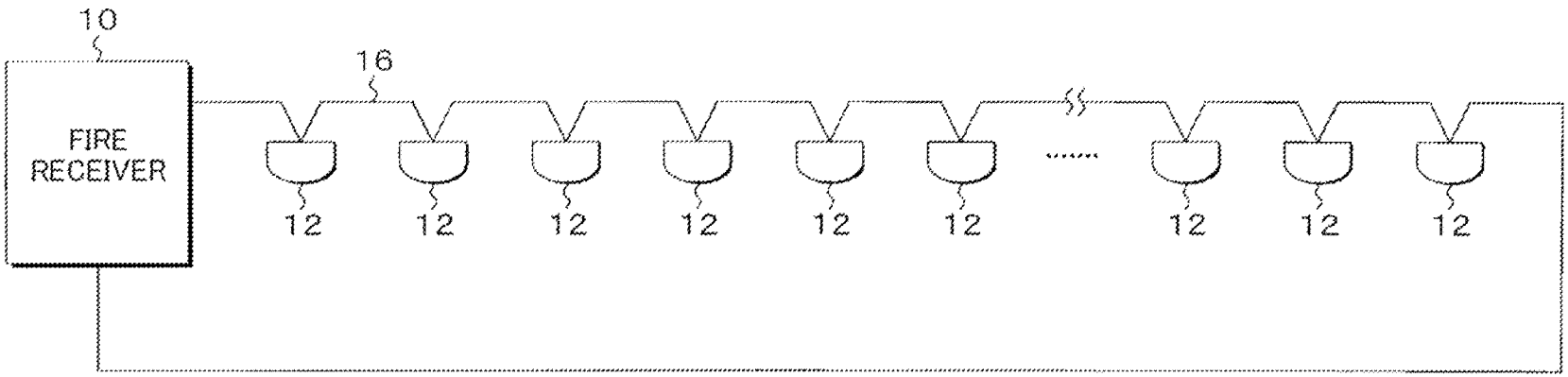

[FIG.2]
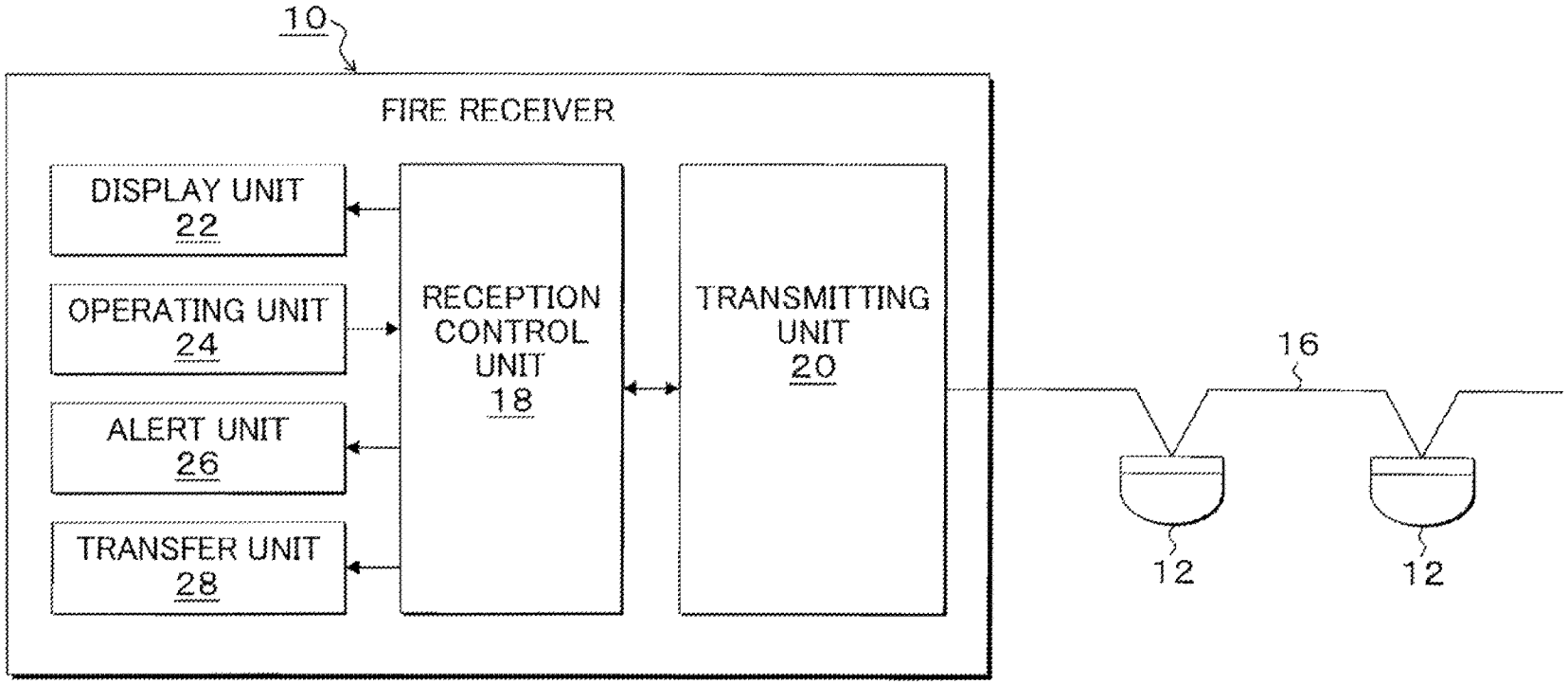

[FIG. 3]

| COMMAND | DATA |
|---|---|
| TEST (17h) | START (81h) |
| | END (80h) |
| ALARM INDICATING LIGHT (18h) | LIGHT ON (01h) |
| | LIGHT OFF (00h) |

[FIG. 4]
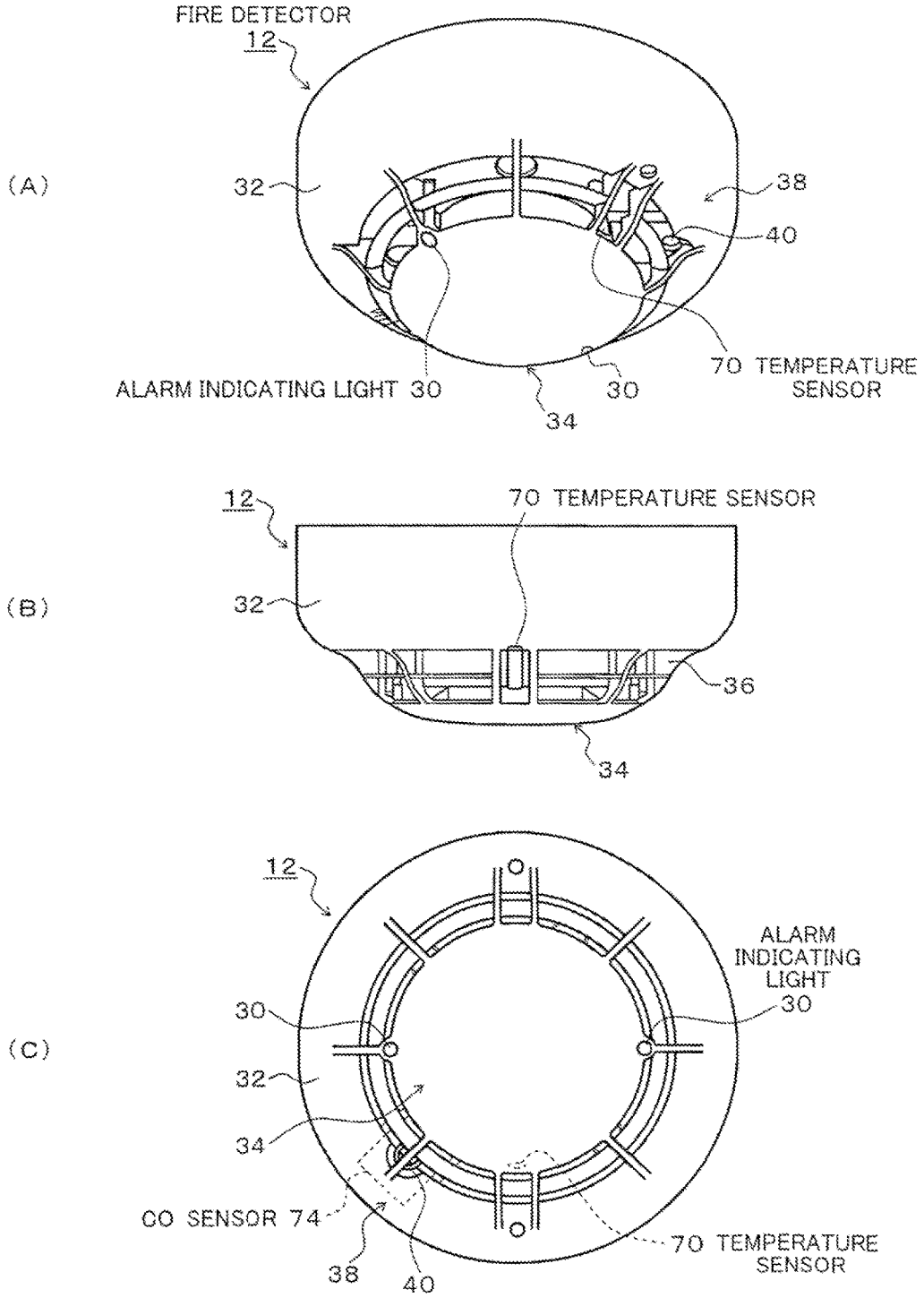

[FIG. 5]
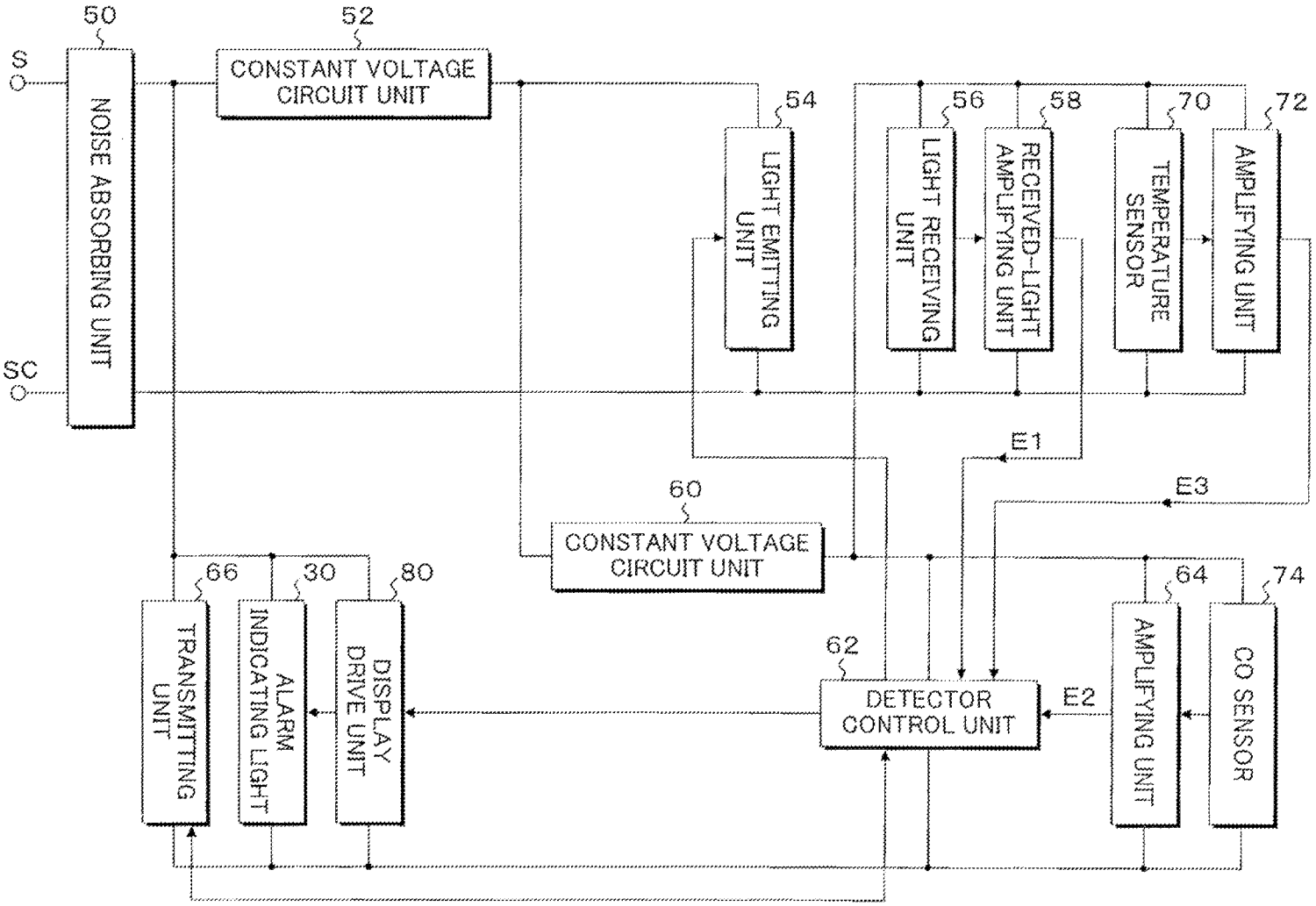

[FIG. 6]
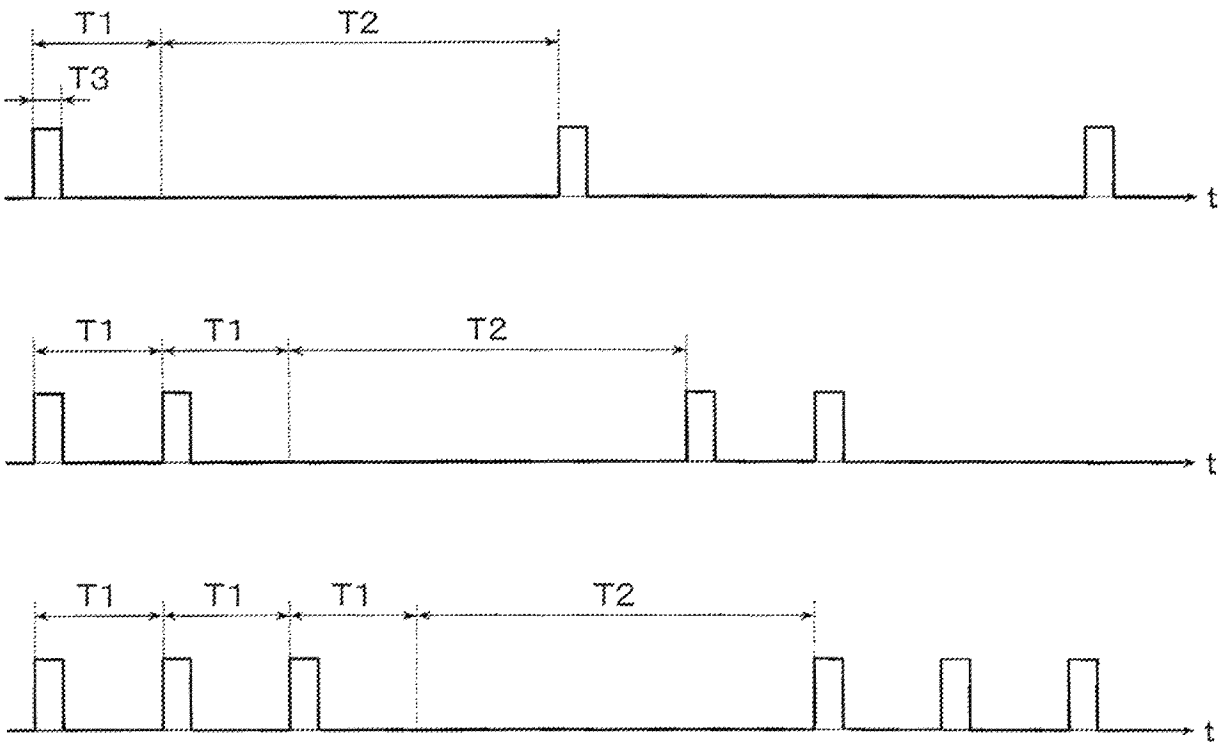

[FIG. 7]
(A)
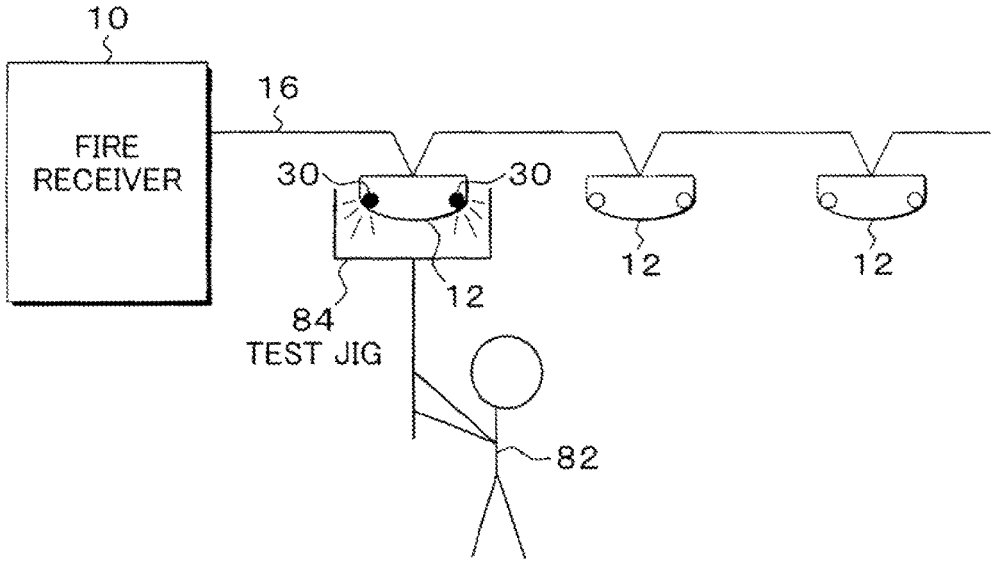
(B)
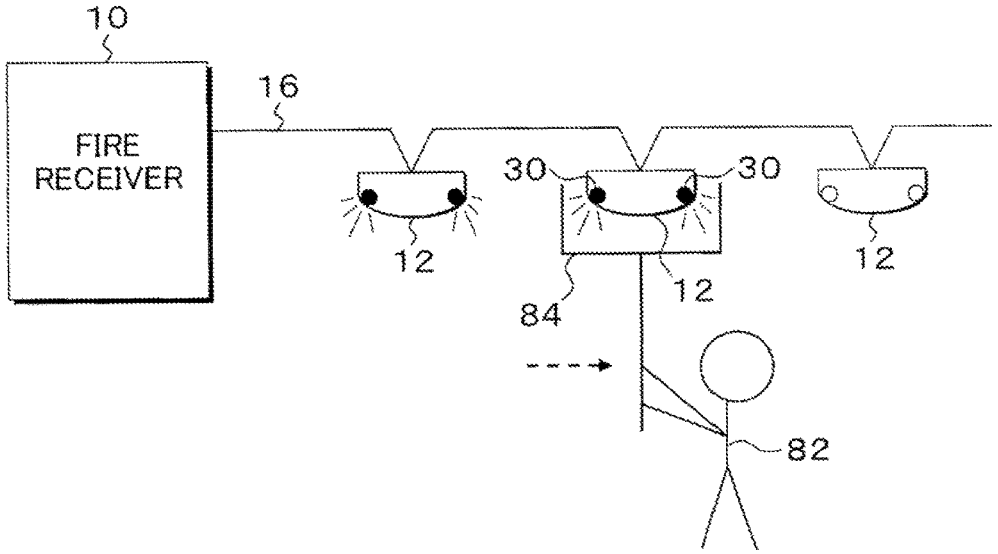

[FIG. 8]
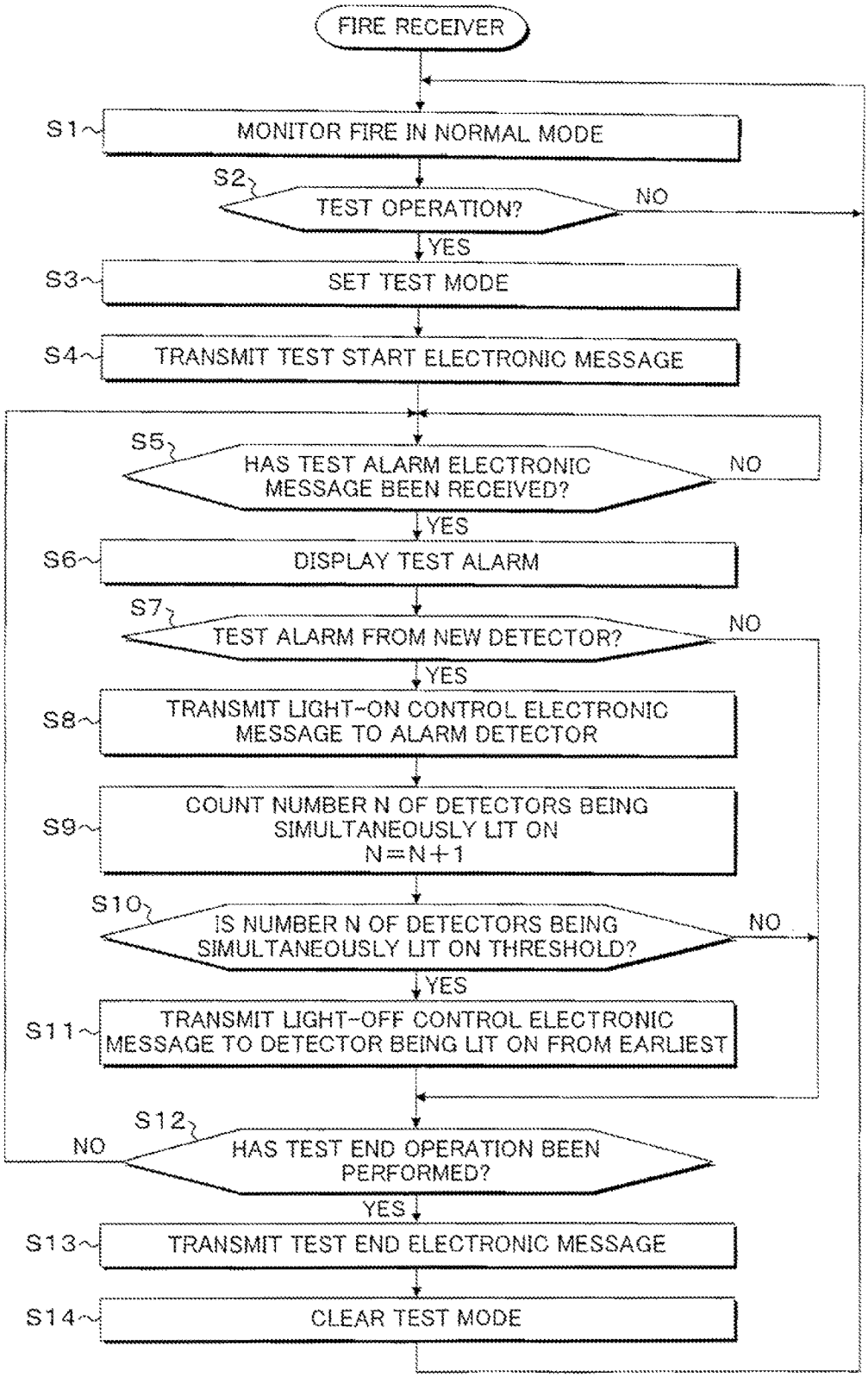

[FIG. 9]
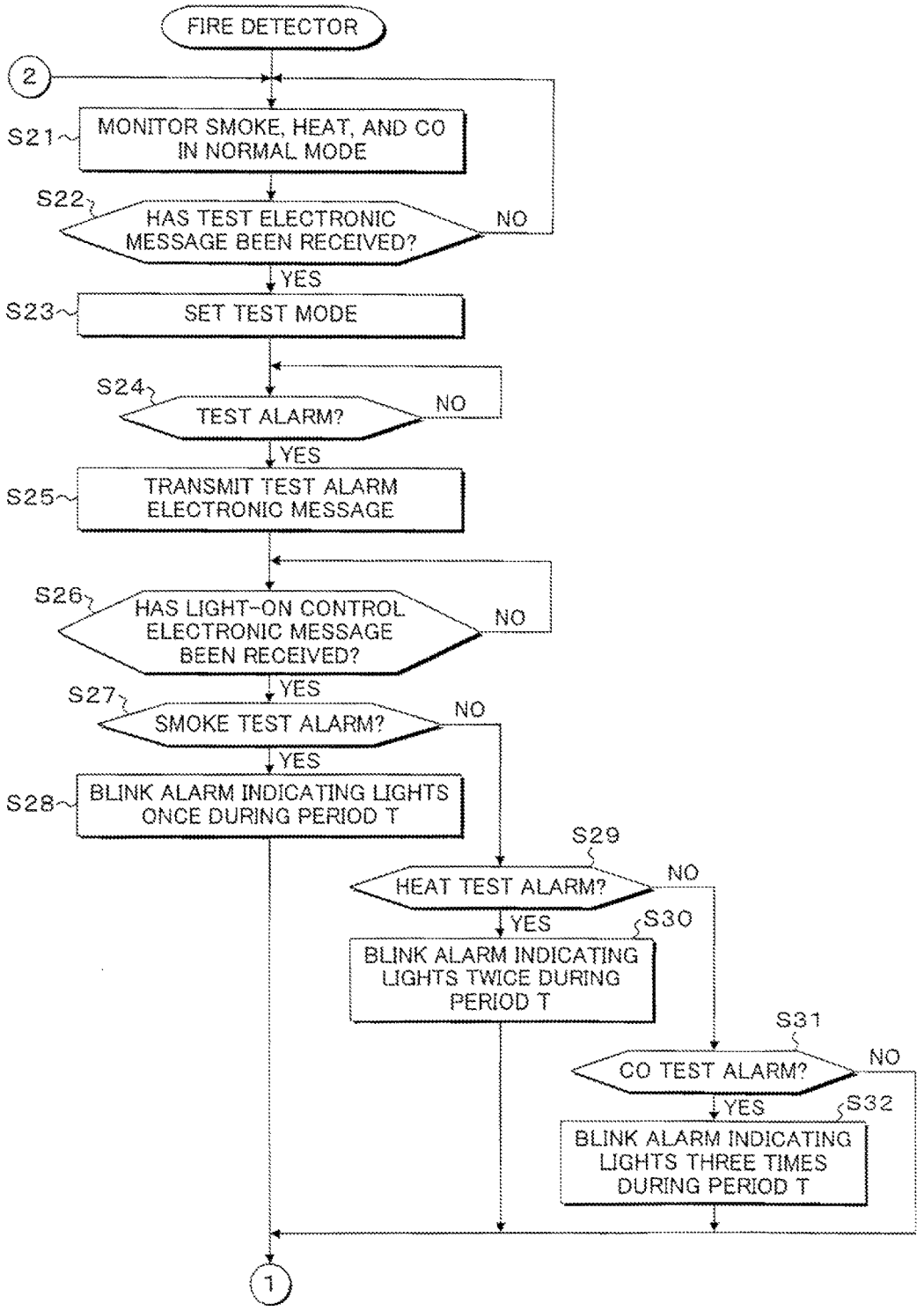

[FIG. 10]
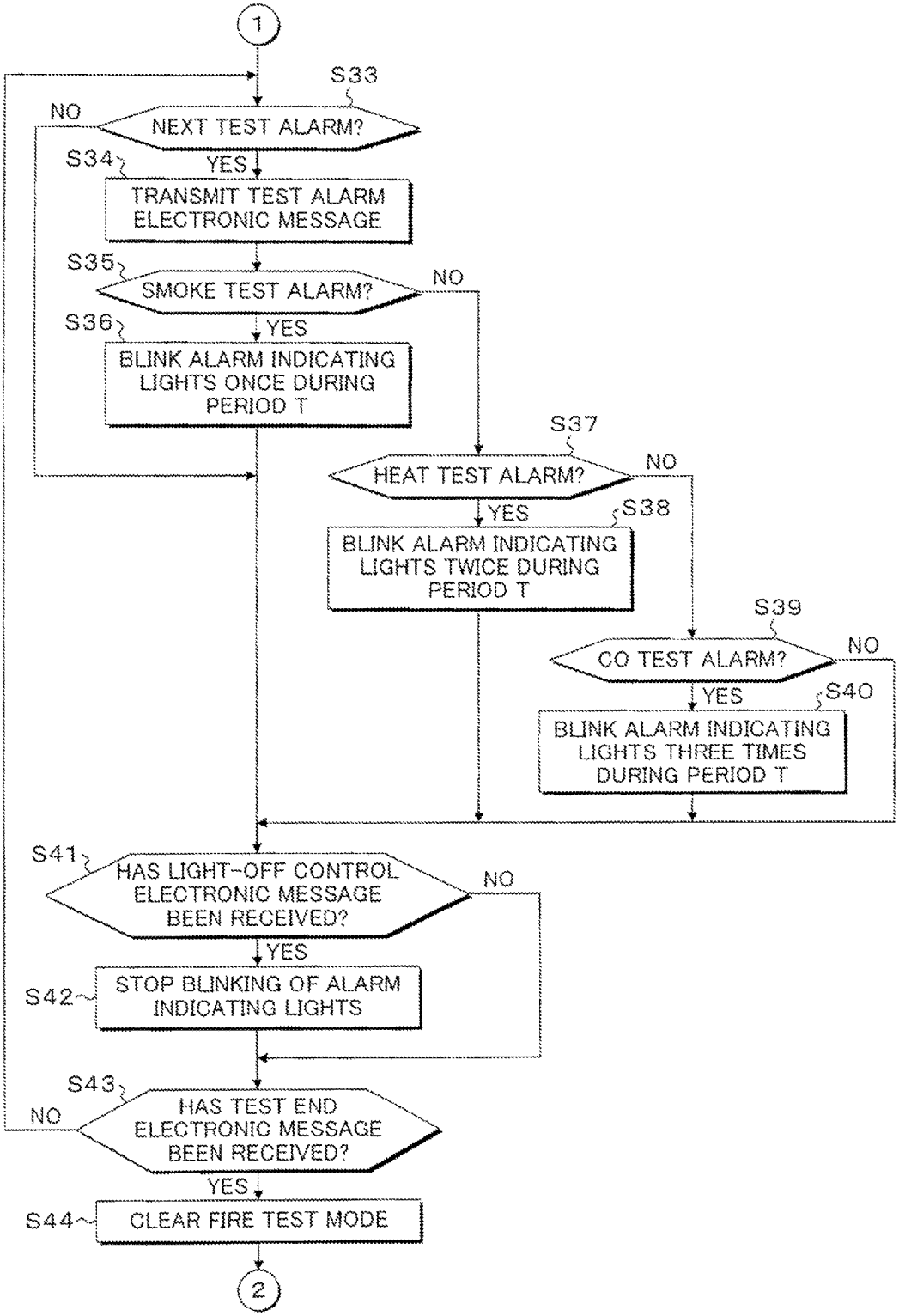

[FIG. 11]
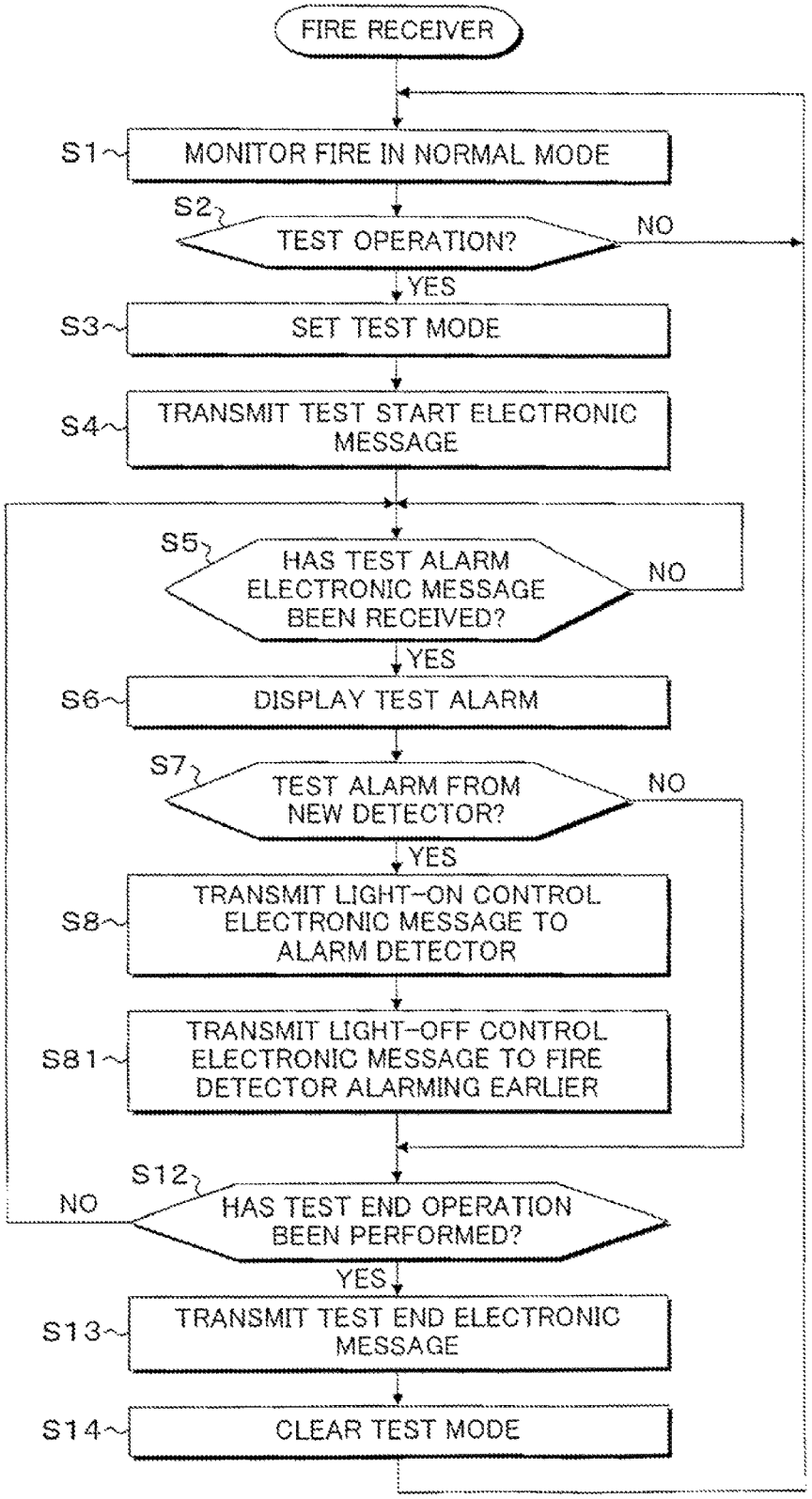

FIRE NOTIFICATION SYSTEM AND TEST METHOD USING TEST JIG THEREFOR

TECHNICAL FIELD

The present invention relates to a fire notification system and testing method therefor, the system in which a fire detector is connected to a transmission path from a fire receiver, the fire detector sensing a concentration of gas such as CO occurring at the time of fire in addition to a smoke concentration and temperature due to fire to sense a fire.

BACKGROUND ART

Conventionally, as a fire detector which senses a fire and outputs an alarm signal to a receiver for a fire alert, a smoke detector which senses smoke due to fire and a heat detector which senses heat (temperature) due to fire have been generally known.

However, only with sensing information such as temperature or smoke concentration, it may be difficult to quickly and appropriately address various fire situations such as smoldering fire and ignited fire. To address this, a composite fire sensor has been known which senses a smoke concentration and temperature due to fire and quickly senses a fire by a composite fire determination without causing an erroneous report or report loss.

On the other hand, at the time of a fire, gas such as CO is known to occur. So, a composite fire detector is also considered in which, other than a fire detecting unit for smoke and heat, a gas sensor is provided to the detector to determine a fire by sensing a gas concentration together with a smoke concentration and heat temperature.

RELATED ART DOCUMENTS

Patent Documents

Patent Document 1: Japanese Patent Application Laid-Open (kokai) No. 2006-268119

Patent Document 2: Japanese Patent Application Laid-Open (kokai) No. 11-312286

DISCLOSURE OF INVENTION

Problems to be Solved by the Invention

Meanwhile, in a fire notification system in which a composite fire detector which senses heat, smoke, and gas to determine a fire is connected to a transmission path from a fire receiver, an inspector sets a test jig to the fire detector at the time of regular inspection, lets smoke flow in for a test alarm, adds heat for a test alarm, and further lets CO gas flow in for an alarm test.

The test jig for use in a test on the composite fire detector includes a smoke generating unit for a smoke sensing test, a heating unit for a heat sensing test, and a gas cylinder for a gas sensing test. With the test jig set to the same fire detector, the smoke generating unit, the heating unit, and the gas cylinder are sequentially switched to confirm a test alarm.

When smoke, heat, and gas alarm tests are conducted by using the test jig in this manner, an alarm indicating light provided to the fire detector is lit on or blinks in accordance with each test alarm. Also, a test alarm electronic message is transmitted to the fire receiver. The fire receiver recognizes and displays a type of the test alarm and a detector address from the received alarm electronic message, allowing the fire detector to be confirmed to have normally operated.

However, although the inspector conducting an alarm test on the fire detector by using the test jig at the installation location can know that a test alarm has been provided from the fact that the alarm indicating light of the fire detector blinks or is lit ON by the test alarm, when the test jig is switched for smoke, heat, and gas to conduct an alarm test, a time lag occurs from a time when smoke, heat, or gas is added to a time of alarming. Even if, for example, the alarm indicating light blinks with the test alarm, it is difficult to know whether this is due to smoke, heat, or gas, and it is required to contact another inspector assigned on a fire receiver side for confirmation by a transceiver or the like, posing a problem of taking time and effort for fire detector inspection known as a walk test mode to be conducted while the inspector is walking and visiting the fire detectors installed in a security zone.

An object of the present invention is to provide a fire notification system and testing method therefor allowing a test alarm by sensing of heat, smoke, and gas to be easily and reliably grasped by an alarm indicating light without a check of an alarm display on a fire receiver side by an inspector who is conducting a test on a fire detector by using a test jig.

Means for Solving the Problems (Fire Notification System)

The present invention is characterized in that, in a fire notification system in which a fire detector which senses a plurality of fire elements including at least two types among a smoke concentration, a heat temperature, and a gas concentration occurring at the time of fire is connected to a transmission path drawn from a fire receiver, the fire receiver sets a test mode to the fire detector when sensing a test operation, and the fire detector performs display control over an alarm indicating light in a varied mode corresponding to an alarm test for each fire element when a test jig is used to conduct alarm tests by sensing of the plurality of fire elements in a state where the test mode is set by the fire receiver.

(Detector Alarm Test Control Procedure)

The reception control unit of the fire receiver sets a receiver test mode and also transmits a test start electronic message to the specified fire detector when sensing the test operation, transmits a light-ON control electronic message to the fire detector transmitting the test alarm electronic message when receiving the test alarm electronic message from the fire detector set in the detector test mode, and, furthermore, transmits a test end electronic message to the plurality of specified fire detectors and clears settings of the receiver test mode when sensing a test end operation, and the detector control unit of the fire detector sets the detector test mode when receiving a test start electronic message from the fire receiver and transmits a test alarm electronic message to the fire receiver when the test jig is used to conduct alarm tests by sensing of the plurality of fire elements in a state in which the detector test mode is set, controls the alarm indicating light so that test alarms by sensing of the plurality of fire elements are displayed in the varied mode when receiving the light-ON control electronic message from the fire receiver, and, furthermore, clears the detector test mode when receiving the test end electronic message from the fire receiver.

(Light-OFF Control 1 Over Detector Emitting Test Alarm)

The reception control unit of the fire receiver senses a number of fire detectors controlling the alarm indicating light by a test alarm and, when the number of fire detectors reaches a predetermined number, specifies a fire detector controlling the alarm indicating light earliest and transmits a light-OFF control electronic message, and the detector control unit of the fire detector stops the control of the alarm indicating light when receiving the light-OFF control electronic message from the fire receiver.

(Light-OFF Control 2 Over Detector Emitting Test Alarm)

The reception control unit of the fire receiver specifies a fire detector controlling the alarm indicating light by a previous test alarm and transmits a light-OFF control electronic message when receiving the test alarm electronic message from a new fire detector, and the detector control unit of the fire detector stops the control of the alarm indicating light when receiving the light-OFF control electronic message from the fire receiver.

(Test Alarm Display by Number of Times of Blinking)

The fire detector varies a number of times of blinking of the alarm indicating light in accordance with test alarms by sensing of the plurality of fire elements.

(Test Alarm Display Regarding Smoke, Heat, and Gas by Repetition of Blinking and Nonoperation)

The plurality of fire elements are a heat temperature, a smoke concentration, and a CO concentration, and the fire detector causes the alarm indicating light to blink once or a plurality of times in accordance with a test alarm by sensing of the smoke concentration, sensing of the heat temperature, or sensing of the gas concentration and then repeats the blinking at intervals of a predetermined nonoperating period.

(Example of Test Alarm Display Regarding Smoke, Heat, and Gas)

The fire detector causes the alarm indicating light to perform one-time blinking, two-time blinking, or three-time blinking at a predetermined blinking period in accordance with the test alarm by sensing of the smoke concentration, sensing of the heat temperature, or sensing of the gas concentration and then repeats the one-time blinking, the two-time blinking, or the three-time blinking at the intervals of the predetermined nonoperating period.

(LED)

The fire detector is provided with one or plurality of LEDs as the alarm indicating light.

(Fire Notification System Testing Method)

The present invention is characterized in that, in testing method for a fire notification system in which a fire detector which senses a plurality of fire elements including a smoke concentration, a heat temperature, a gas concentration due to fire is connected to a transmission path drawn from a fire receiver, wherein the fire receiver sets a test mode to the fire detector when sensing a test operation, and the fire detector performs display control over an alarm indicating light in a varied mode corresponding to an alarm test for each fire element when a test jig is used to conduct alarm tests by sensing of the plurality of fire elements in a state where the test mode is set by the fire receiver.

(Walk Test Mode Control Procedure)

The fire receiver sets a receiver test mode and also transmits a test start electronic message to the fire detector when sensing the test operation, the fire detector sets the detector test mode when receiving a test start electronic message from the fire receiver and transmits a test alarm electronic message to the fire receiver when the test jig is used to conduct an alarm test by sensing of the plurality of fire elements in a state in which the detector test mode is set, the fire receiver transmits a light-ON control electronic message to the fire detector transmitting the test alarm electronic message when receiving the test alarm electronic message from the fire detector set in the detector test mode, the fire detector transmitting the test alarm electronic message controls the alarm indicating light so that test alarms by sensing of the plurality of fire elements are displayed in the varied mode when receiving the light-ON control electronic message from the fire receiver, the fire receiver transmits a test end electronic message to the fire detectors and clears the setting of the receiver test mode when sensing a test end operation, and the fire detector clears the detector test mode when receiving the test end electronic message from the fire receiver.

Features of the fire notification system testing method other than the above are identical to those of the above-described fire notification system.

Effects of the Invention (Effects of Fire Notification System)

In the present invention, in a fire notification system in which a fire detector which senses fire factors including a smoke concentration, a heat temperature, and a gas concentration due to fire is connected to a transmission path drawn from a fire receiver, the fire receiver sets a test mode to the fire detector when sensing a fire test operation, and the fire detector performs display control over an alarm indicating light in a varied mode corresponding to an alarm test for each fire element when a test jig is used to conduct alarm tests by sensing of the plurality of fire elements in a state where the test mode is set by the fire receiver. Thus, for the fire detectors installed in the security zone, when the inspector sequentially performs test operation with, for example, smoke inflow, heat, and test gas inflow by using a test jig, the alarm indicating light of the fire detectors performs alarm display in a varied mode for test alarm by smoke sensing, test alarm by heat sensing, and test alarm by gas sensing. Thus, the inspector can easily know whether the test alarm is by smoke, heat, or gas without requiring a check of the type of test alarm by contacting the fire receiver side, and can successively perform alarm tests (tests in the walk test mode) on the plurality of fire detectors set in the test mode by the instruction from the fire receiver, thereby allowing inspection work on the fire detectors to efficiently proceed. Also, even a detector which does not determine a fire only with a CO concentration, such as a fire detector which determines a fire when the smoke concentration or the heat temperature exceeds a predetermined threshold and the CO concentration exceeds a predetermined threshold as well as a sensor which determines a fire by changing the thresholds of the smoke concentration and the heat temperature in accordance with the CO concentration, can pro a test alarm only with the CO concentration at the time of inspection and perform test alarm display in accordance with the CO concentration. Thus, the inspector can reliably conduct a test for each fire element included in the fire detector and confirm the test result at the location of the fire detector.

(Effects by Detector Alarm Test Control Procedure)

Also, the fire receiver sets a receiver test mode and also transmits a test start electronic message to the specified fire detector when sensing the test operation, transmits a light-ON control electronic message to the fire detector transmitting the test alarm electronic message when receiving the test alarm electronic message from the fire detector set in the detector test mode, and, furthermore, transmits a test end electronic message to the fire detectors and clears the setting of the receiver test mode when sensing a test end operation. On the other hand, the fire detector sets the detector test mode when receiving a test mode setting electronic message from the fire receiver and transmits a test alarm electronic message to the fire receiver when the test jig is used to conduct alarm tests by sensing of the plurality of fire elements in a state in which the detector test mode is set, controls the alarm indicating light so that test alarms by sensing of the plurality of fire elements are displayed in the varied mode when receiving the light-ON control electronic message from the fire receiver, and, furthermore, clears the detector test mode when receiving the test end electronic message from the fire receiver. Thus, when alarm tests by sensing of a plurality of fire elements, for example, sensing of a smoke concentration, sensing of a heat temperature, or sensing of a gas concentration, are successively conducted on the fire detectors set in the detector test mode by using a test jig, the display of the alarm indicating light by the test alarm of the first fire element is stopped based on the test alarm of the next fire element and is switched to new test alarm display. Even if test alarms of the plurality of fire elements continue, the display of the alarm indicating light always corresponds to the latest test alarm. Thus, with display of the alarm indicating light in a varied mode by following the order of the test alarms due to the plurality of fire factor, the test alarms due to the plurality of fire factors are identifiable.

Also, in the display control over the alarm indicating light based on the test alarm, a test alarm electronic message is transmitted from the fire detector to the fire receiver, and the fire receiver transmits a light-ON control electronic message to the fire detector of the transmission source of the test alarm electronic massage for display control over the alarm indicating light. Thus, the display of the alarm indicating light by the test alarm of the fire detector means that transmission and reception of electronic messages have been performed between the fire detector emitting a test alarm and the fire receiver, and it is possible to simultaneously confirm that the fire receiver can normally operate with the test alarm.

(Effects by Light-OFF Control Over Fire Detector Emitting Test Alarm)

Also, the reception control unit of the fire receiver senses a number of fire detectors controlling the alarm indicating light by a test alarm and, when the number of fire detectors reaches a predetermined number, specifies a fire detector controlling the alarm indicating light earliest and transmits a light-OFF control electronic message, and the detector control unit of the fire detector stops the control of the alarm indicating light when receiving the light-OFF control electronic message from the fire receiver. Thus, when alarm tests on the plurality of fire detectors are conducted, the alarm indicating lights are simultaneously subjected to display control by test alarms until the number of fire detectors reaches a number determined by an allowable range of the power supply capacity of the fire receiver. It is possible to easily distinguish between a tested fire detector and a non-tested fire detector. When a plurality of inspectors simultaneously conduct alarm tests, the alarm tests on the fire detectors can be prevented from being redundantly conducted.

Also, the reception control unit of the fire receiver specifies a fire detector controlling the alarm indicating light by a previous test alarm and transmits a light-OFF control electronic message every time the test alarm electronic message is received from a new fire detector, and the detector control unit of the fire detector stops the control of the alarm indicating light when receiving the light-OFF control electronic message from the fire receiver. Thus, when a plurality of fire detectors are successively tested, if one fire detector is tested, the previous alarm test is conducted to stop the control over the alarm indicating light of the fire detector, and only the display control over the alarm indicating light of the fire detector emitting a test alarm is performed. It is possible to reduce power consumption by control over the alarm indicating lights.

(Effects by Test Alarm Display by Number of Times of Blinking)

Also, the fire detector varies a number of times of blinking of the alarm indicating light in accordance with test alarms by sensing of the plurality of fire elements. Thus, a correspondence between the type of the test alarm and the display contents of the alarm indicating light can be easily grasped.

(Effects by Test Alarm Display Regarding Smoke, Heat, and Gas by Repetition of Blinking and Nonoperation)

Also, the plurality of fire factors are a smoke concentration, a heat temperature and a CO concentration, and the fire detector causes the alarm indicating light to blink once or a plurality of times in accordance with a test alarm by sensing of the smoke concentration, sensing of the heat temperature, or sensing of the gas concentration and then repeats the blinking at intervals of a predetermined nonoperating period. Thus, when the test alarm by the number of times of blinking of the alarm indicating light is switched, a spare time by a predetermined nonoperating period is inserted, thereby allowing the type of test alarm by changing the predetermined number of times of blinking to be easily and reliably recognized.

For example, the fire detector causes the alarm indicating light to perform one-time blinking, two-time blinking, or three-time blinking at a predetermined blinking period in accordance with the test alarm by sensing of the smoke concentration, sensing of the heat temperature, or sensing of the gas concentration and then repeats the one-time blinking, the two-time blinking, or the three-time blinking at the intervals of the predetermined nonoperating period. Thus, the test alarms of the plurality of fire elements can be easily and reliably identified from a change of the predetermined number of times of blinking, such as a test alarm by smoke concentration sensing when the light blinks once, a test alarm by heat temperature sensing when the light blinks twice, and a test alarm by gas sensing when the light blinks three times.

(Effects by Fire Notification System Testing Method)

Effects by the fire notification system testing method of the present invention are substantially identical to the above-described effects of the fire notification system.

BRIEF DESCRIPTION OF THE DRAWINGS

FIG. 1 is a descriptive diagram depicting a general outline of a fire notification system according to the present invention.

FIG. 2 is a block diagram depicting a functional structure of a fire receiver.

FIG. 3 is a descriptive diagram depicting a list of commands and data to be set to a control electronic message.

FIG. 4 is a descriptive diagram depicting an embodiment of a fire detector which senses heat, smoke, and CO according to the present invention.

FIG. 5 is a block diagram depicting a detector circuit in the embodiment of FIG. 4.

FIG. 6 is a time chart depicting display control over an alarm indicating light supporting a test alarm by sensing of a smoke concentration, heat temperature, and CO concentration.

FIG. 7 is a descriptive diagram depicting a general outline of a walk test mode in the fire notification system.

FIG. 8 is a flowchart depicting fire receiver control operation.

FIG. 9 is a flowchart depicting fire detector control operation.

FIG. 10 is a flowchart depicting the control operation continued from FIG. 9.

FIG. 11 is a flowchart depicting fire receiver control operation according to another embodiment.

BEST MODE FOR CARRYING OUT THE INVENTION

[General Outline of Fire Notification System]

FIG. 1 is a descriptive diagram depicting a general outline of a fire notification system according to the present invention. As depicted in FIG. 1, the fire notification system is configured of a fire receiver 10 and a plurality of fire detectors 12. From the fire receiver 10, a transmission path 16 is drawn toward a facility's security zone, and the plurality of fire detects 12 are connected to the transmission path 16.

Each fire detector 12 is set with a unique address. For example, 128 addresses can be set at maximum to one circuit of the transmission path 16, and this allows 128 fire detectors 12 at maximum to be connected to the transmission path 16. Note that the maximum number of addresses per one circuit of the transmission path 16 may be increased as required, such as 256 addresses or 512 addresses. Also, when the number of fire detectors 12 installed in the security zone exceeds the maximum number of addresses in the transmission path 16, the number of transmission paths 16 is increased.

When sensing a plurality fire elements due to fire, for example, a smoke concentration, heat temperature, and CO concentration, the fire detector transmits each corresponding alarm electronic message to the fire receiver 10. When receiving the alarm electric message from the fire detector 12, the fire receiver 10 outputs a fire alert, and causes an alarm location to be displayed based on the detector address.

Monitoring control in normal mode by the fire receiver 10 is as follows, for example. The fire receiver 10 transmits a collective AD conversion electronic message which specifies a common address for all fire detectors 12 at intervals of, for example, one second, a sensing signal of each of the fire elements including the smoke concentration, heat temperature, and CO concentration is subjected to AD conversion at every fire detector 12 and is stored in a memory. Subsequently, polling electronic messages which sequentially specify the addresses of the fire detectors 12 are transmitted. For the polling electronic message specifying its own address, each piece of data of the smoke concentration, heat temperature, and CO concentration retained in the memory or an alarm situation of each fire element is transmitted via a response electronic message to the fire receiver 10 for causing a predetermined process to be performed.

The fire detector 12 senses a fire alarm when any of the smoke concentration, heat temperature, and CO concentration exceeds its corresponding threshold, and transmits a fire interrupt electronic message to the fire receiver 10. Also, when a test alarm is provided by a test jig, the fire detector set in a test mode by an electronic message from the fire receiver transmits a test alarm electronic message in accordance with the component element of the smoke concentration or heat temperature to the fire receiver. Note that a detector may be of a type which determines a fire when the smoke concentration or heat temperature exceeds a predetermined threshold and the CO concentration exceeds a predetermined concentration. Also in this case, a test alarm can be provided for each of sensing elements of a smoke concentration sensing unit, a heat temperature sensing unit, and a CO concentration sensing unit. When any of sensing outputs exceeds a threshold, a test alarm signal in accordance with the sensing element can be sent to the fire receiver 10. The fire receiver 10 receiving the fire interrupt electronic message transmits a group search electronic message which specifies a group address by, for example, high-order bits except four low-order bits of the detector addresses, to search for a fire alarm group, sequentially transmits search electronic messages specifying detector addresses in the group, specifies an address of a fire detector providing the fire interrupt, and causes a fire occurring location to be displayed.

The fire notification system conducts inspections on a regular basis. These inspection items include an item known as a walk test mode, in which an inspector conducts alarm tests on the fire detectors 12 installed in the security zone by using a test jig.

In the fire notification system of the present invention, to conduct an inspection in the walk test mode, a test mode is first set to the fire detectors 12 by operation of the fire receiver 10.

In the fire notification system of FIG. 1, the plurality of, for example, 128, fire detectors 12 are connected to the transmission path 16. In a state in which all fire detectors 12 are set in the test mode by the fire receiver 10, when the inspector uses a test jig to conduct an alarm test by sensing of a smoke concentration, an alarm test by sensing of a heat temperature, and an alarm test by sensing of a CO concentration, alarm indicating lights are subjected to display control in a varied mode in accordance with the respective alarm tests.

Thus, by viewing the display associated with the test alarms of the alarm indicating lights, the inspector can easily know whether the test alarm is based on sensing of a smoke concentration, heat temperature, or CO concentration without requiring a check of a type of the test alarm by making contact with a fire receiver side, and can successively conduct alarm tests in the walk test mode on all fire detectors 12 set in the test mode.

[Fire Receiver]

FIG. 2 is a block diagram depicting a functional structure of the fire receiver. As depicted in FIG. 2, the fire receiver 10 includes a reception control unit 18. The reception control unit 18 is provided with a transmitting unit 20, a display unit 22, an operating unit 24, an alert unit 26, and a transfer unit 28.

The reception control unit 18 is a function implemented by, for example, execution of a program. As hardware, a one-chip-type processor including a CPU, memory, various input/output ports, and so forth is used.

The reception control unit 18 sets a receiver test mode to its own when detecting a fire test operation by the operating unit 24, and performs control of instructing the transmitting unit 20 to transmit a test start electronic message without address specification or a test start electronic message specifying a common address which is common among all fire detectors. This causes all fire detectors 12 connected to the transmission path 16 to be set in a detector test mode.

Also, when receiving a test alarm electronic message from the fire detector 12 set in the detector test mode, the reception control unit 18 causes an alarm type of smoke, heat, or CO and an alarm address included in the test alarm electronic message to be displayed, and also performs control of transmitting a light-ON control electronic message to the fire detector 12 transmitting the test alarm electronic message.

Also, every time a test alarm electronic message is received from a new fire detector 12, the reception control unit 18 counts a number N of fire detectors 12 controlling alarm indicating lights 30 by test alarms so far and, when the counted number N reaches a predetermined threshold Nth, performs control of specifying the earliest fire detector 12 performing light-emission control over the alarm indicating lights and transmitting a light-OFF control electronic message to stop light-ON control of the alarm indicating light, thereby ensuring stability of power supply to the system. Here, the threshold number Nth of fire detectors conducting a test alarm for transmitting a light-OFF control electronic message is assumed to be a predetermined number defined in an allowable range of the power supply capacity of the fire receiver 10.

Also, as another embodiment of light-OFF control over the fire detectors 12, the reception control unit 18 performs light-OFF control of, every time a test alarm electronic message is received from a new fire detector 12, specifying a fire detector 12 performing light-OFF control over the alarm indicating lights 30 based on a previous test alarm, transmitting a light-OFF control electronic message, and stopping light-ON control over the alarm indicating lights 30.

Also, when detecting a test end operation by the operating unit 24, the reception control unit 18 performs control of transmitting test end electronic messages to all fire detectors 12 and also clearing the setting of the receiver test mode.

Here, a control electronic message to be transmitted from the fire receiver 10 to the fire detectors 12 is in a format including a command, address, data, and check sum. For example, a command and data to be set to a test start electronic message, test end electronic message, light-ON control electronic message, and light-OFF control electronic message are as depicted in, for example, a list of FIG. 3.

In FIG. 3, for example, a test command is a command code (17*h*), and is combined with start data (81*h*) as data, thereby becoming a test start command. Also, if combined with end data (80*h*), the command becomes a test end command. Here, h represents hexadecimal code of binary four bits. Also, the values of the command code and data are merely examples, and appropriate values are set as required.

[Fire Detector]

(Structure of Fire Detector)

FIG. 4 is a descriptive diagram depicting an embodiment of the fire detector which senses smoke, heat, and CO according to the present invention, FIG. 4(A) depicting a perspective view viewed from below in a state of being attached to a ceiling surface, FIG. 4(B) depicting a side view, and also FIG. 4(C) depicting a plan view viewed from below.

As depicted in FIG. 4, the fire detector 12 is configured of a detector main body accommodated inside and a cover 32 disposed outside. The cover 32 forms a chamber accommodating unit 34 oriented downward from the center on an approximately cylindrical base side. On the periphery of the chamber accommodating unit 34, a plurality of smoke-plume inlets 36 are open. Also, the alarm indicating lights 30 are provided at two locations on the side surface of the cover 32 on an attachment side. Each alarm indicating light 30 is provided with two-color LEDs which each emit light in, for example, red and green, blinking in green for polling from the fire receiver 10 and blinking in red for a fire alarm in a normal state.

A CO sensor accommodating unit 38 is formed at a part of the cover 32 serving as the outside of the chamber accommodating unit 34. Inside the CO sensor accommodating unit 38, as indicated by a dotted line in FIG. 4(C), an electrochemical CO sensor 74 is incorporated.

An opening hole 40 is formed in the surface of the cover 32 of the CO sensor accommodating unit 38. The opening hole 40 takes in CO gas flowing with smoke by a heat air current associated with fire to the CO sensor 74 inside.

Accommodated inside the chamber accommodating unit 34 is a scattered-light smoke sensing unit, which senses, at a light-receiving element, scattered light of light from the light-receiving element due to smoke flowing in from the smoke-plume inlets 36 and obtains a smoke concentration sensing signal.

Between the smoke-plume inlets 34 formed on the periphery of the chamber accommodating unit 34, a temperature sensor 70 is disposed to protrude downward. As the temperature sensor 70, an appropriate temperature sensor such as a thermistor or a semiconductor-type temperature sensor can be used.

(Detector Circuit Unit)

FIG. 5 is a block diagram depicting a detector circuit unit in the embodiment of FIG. 4. As depicted in FIG. 5, the detector circuit unit has an S terminal and an SC terminal, and connected hereto is a transmission line (power-supply dual-purpose signal line) drawn from the fire receiver.

Subsequently to the S and SC terminals, a noise absorbing unit 50 is provided, absorbing and removing a surge, noise, and so forth occurring in the detector circuit.

Subsequently, a constant voltage circuit unit 52 is provided, converting a power supply voltage supplied from the transmission line into a predetermined power supply voltage for output. The power supply voltage from the constant voltage circuit unit 52 is supplied to a light-emitting unit 54. The power supply voltage of the constant voltage circuit unit 52 is converted by a constant voltage circuit unit 60 into a constant voltage lower than the power supply voltage for power supply to a light receiving unit 56, a received-light amplifying unit 58, the temperature sensor 70, an amplifying unit 72, a detector control unit 62, the electrochemical CO sensor 74, and an amplifying unit 64.

The light-emitting unit 54 intermittently causes the light-emitting elements such as LEDs to be driven to emit light. The light receiving unit 56 outputs a light receiving signal from the light receiving elements such as photodiodes, and the weak light receiving signal is amplified by the received-light amplifying unit 58, which outputs a smoke sensing signal E1 corresponding to the smoke concentration.

As the detector control unit 62, a processor known as a one-chip CPU is used, including a CPU, RAM, ROM, A/D conversion port, and various input/output ports.

The CO sensor 74 is, for example, a triode electrochemical CO sensor. The sensor is filled with an electrolytic solution in contact with outside air. A working electrode, a counter electrode, and a reference electrode immersed in the electrolytic solution are disposed as being separated from one another.

When CO gas makes contact with the electrolytic solution in the CO sensor 74 from outside, a current associated with a CO gas oxidative effect near the working electrode outflows from the working electrode. This current outflowing from the working electrode becomes a current proportional to the gas concentration of the CO gas in contact with the CO sensor 74. Connected to the working electrode is the amplifying unit 64, which reversely amplifies a voltage input proportional to the current input from the working electrode, thereby outputting a CO sensing signal E2 which increases in accordance with the gas concentration from a working voltage when the CO gas concentration is approximately 0 ppm.

The sensing signal from the temperature sensor 70 is amplified by the amplifying unit 72, which outputs a temperature sensing signal E3 in accordance with the heat temperature.

The detector control unit 62 converts, by the AD conversion port, the smoke sensing signal E1 from the received-light amplifying unit 58 into smoke data, converts the CO gas sensing signal E2 from the amplifying unit 64 into CO data, and further converts the temperature sensing signal E3 from the amplifying unit 72 into temperature data.

The detector control unit 62 is a function implemented by execution of a program by the CPU, determining a fire alarm in a normal monitoring state by following a predetermined fire determination procedure based on the smoke data, the CO data, and the temperature data read from the AD conversion port. Also, every time a polling electronic message from the fire receiver is received, the detector control unit 62 causes the two-color LEDs provided to the alarm indicating lights 30 to blink in green.

Also, when a detector test mode is set by an instruction from the fire receiver 10, the detector control unit 62 performs predetermined test control associated with the test alarm.

Provided on an output side of the detector control unit 62 is a transmitting unit 66. The transmitting unit 66 is connected to an output side of the noise absorbing unit 50 for transmission and reception of various electronic messages to and from the fire receiver 10 via a transmission line by serial transmission.

Also, provided on the output side of the detector control unit 62 are the alarm indicating lights 30 via a display drive unit 80. The alarm indicating lights 30 are driven to be lit ON based on the determination as to the fire alarm by the detector control unit 62. Also, when a detector test mode is set to the detector control unit 62, display control is performed in a varied mode in accordance with alarm contents based on sensing of a test alarm due to smoke, heat, or CO.

(Fire Detector Test Control)

The detector control unit 62 sets a detector test mode when receiving a test start electronic message from the fire receiver 10 via the transmitting unit 66, stops blinking in green of the alarm indicating lights 30 in the normal monitoring mode, and, when conducting an alarm test by sensing of a smoke concentration, sensing of a heat temperature, or sensing of a CO concentration by using a test jig in a state where a detector test mode is set, performs control of instructing the transmitting unit 66 to transmit a test alarm electronic message to the fire receiver 10.

Also, when receiving a light-ON control electronic message from the fire receiver 10 via the transmitting unit 66, the detector control unit 62 performs display control over the alarm indicating lights 30 in a varied mode so as to display a test alarm by sensing of a smoke concentration, sensing of a heat temperature, or sensing of a CO concentration.

Also, when receiving a test end electronic message from the fire receiver 10 via the transmitting unit 66, the detector control unit 62 performs control of clearing the detector test mode and returning to the normal monitoring state.

(Test Alarm Display of Alarm Indicating Light)

FIG. 6 is a time chart depicting display control of each alarm indicating light supporting a test alarm based on sensing of a smoke concentration, heat temperature, and CO concentration. FIG. 6(A) depicts an alarm display of smoke sensing, FIG. 6(B) depicts an alarm display of heat sensing, and FIG. 6(C) depicts an alarm display of CO sensing.

In the test alarm display by smoke sensing in FIG. 6(A), the alarm indicating light 30 blinks once in a blink period T1 with light-ON for a light-ON time T3 and subsequent light-OFF, subsequently waits in a predetermined nonoperating period T2, and then repeats this.

Also, in the test alarm display by heat sensing in FIG. 6(B), the alarm indicating light 30 blinks twice in the blink period T1 with light-ON for the light-ON time T3 and subsequent light-OFF twice, subsequently waits in the predetermined nonoperating period T2, and then repeats this.

Furthermore, in the test alarm display by CO sensing in FIG. 6(C), the alarm indicating light 30 blinks three times in the blink period T1 with light-ON for the light-ON time T2 and subsequent light-OFF three times, subsequently waits in a predetermined nonoperating period T3, and then repeats this.

Here, the blink period T1 is, for example, one second, the blink period T2 is, for example, three seconds, and the light-emitting time T3 is, for example, ten milliseconds.

With these changes in the number of times of blinking corresponding to the test alarm of the alarm indicating light 30, the inspector conducting an alar test by using a test jig can easily and readily grasp a test alarm by sensing of a smoke concentration if the light blinks once, a test alarm by sensing of a heat temperature if the light blinks twice, and a test alarm by sensing of a CO concentration if the light blinks three times, allowing an alarm test on the fire detector 12 to be conducted without contacting a fire receiver side.

[Fire Detector Inspection Work in Walk Test Mode]

FIG. 7 is a descriptive diagram depicting a general outline of an inspection work in the walk test mode in the fire notification system, FIG. 8 is a flowchart depicting fire receiver control operation, and FIG. 9 is a flowchart depicting fire detector control operation.

(General Outline of Inspection Work)

As depicted in FIG. 7(A), when the fire detectors are inspected in the walk test mode, all fire detectors 12 are first set in a detector test mode by operation of the fire receiver 10. In this state, an inspector 82 sets a test jig 84 to an appropriate fire detector 12 to conduct a test by heating the fire detector 12, a test by letting smoke flow in, and a test by letting CO gas flow in, by operation of the test jig 84.

For this test operation using the test jig 84, if the fire detector 12 provides a test alarm by sensing of smoke, heat, or CO, the alarm indicating lights 30 provided to the fire detector 12 periodically blink. It can be recognized that the alarm is a test alarm by sensing of a smoke concentration if the lights blink once, a test alarm by sensing of a heat temperature if the lights blink twice, a test alarm by sensing of a CO concentration if the lights blink three times.

When the inspection of the first fire detector 12 ends in this manner as depicted in FIG. 7(B), the inspection proceeds to the next fire detector 12, setting the test jig 84 and performing a test operation in a similar manner.

Here, regarding the alarm indicating lights 30 of the fire detectors 12 subjected to the test, the alarm indicating lights 30 of the fire detectors subjected to the test are simultaneously lit ON until the number N of fire detectors 12 tested reaches the predetermined number Nth. When an alarm test is conducted on the next fire detector 12, light emission of the fire detector 12 emitting light earliest stops.

[Test Control Associated with Inspection Work]

FIG. 8 is a flowchart depicting fire receiver control operation, and FIG. 9 is a flowchart depicting fire detector control operation. With reference to FIG. 8 and FIG. 9, control operation of the fire receiver and the fire detectors associated with the inspection work in the walk test mode of the fire notification system is described as follows.

(Fire Receiver Control)

As depicted in FIG. 8, the reception control unit 18 of the fire receiver 10 is performing fire monitoring in normal mode at step S1. Prior to an inspection work, when the inspector performs a test operation at the fire receiver 10, this is determined at step S2. At step S3, the fire receiver 10 sets a test mode, and subsequently at step S4, transmits a test start electronic message to all fire detectors 10.

In this state, if the inspector visits the installation location of any fire detector 12 and uses the test jig to conduct an alarm test, a test alarm electronic message is received from the fire detector 12 at step S5, and a test alarm regarding smoke, heat, or CO is displayed at step S6.

Subsequently at step S7, when it is determined from a detector address included in the test alarm electronic message that the alarm is a test alarm of a new fire detector 12, the control proceeds to step S8, transmitting to the fire detector 12 a light-ON control electronic message with a detector address of the test alarm being specified.

Subsequently, the control proceeds to step S10, counting the number N of detectors simultaneously performing light-ON control over the alarm indicating lights by the alarm test. At step S10, when the number N of detectors during simultaneous light-ON control is smaller than the threshold Nth, the control skips step S11. When the number N of detectors during simultaneous light-ON control reaches the threshold Nth, a light-OFF control electronic message with an address of the earliest fire detector during light-ON control being specified is transmitted at Step S11.

Subsequently, the control repeats the process from step S5 until a test end operation is sensed at step S12. When a test end operation is sensed at step S12, the control proceeds to step S13 to transmit a test end electronic message to all fire detectors. Subsequently at step S14, the test mode is cleared and the control is returned to fire monitoring in normal mode at step S1.

(Fire Detector Control)

As depicted in FIG. 9, the detector control unit 62 of the fire detector 12 monitors smoke, heat, and CO in normal mode at step S21. During this monitoring in normal mode, when reception of a test start electronic message transmitted by any fire receiver 10 is sensed at step S22, a test mode is set at step S23.

In a state where the test mode is set, if the inspector visits installation location of any fire detector 12 and uses the test jig to conduct an alarm test, the detector control unit 62 of the fire detector 12 senses a test alarm at step S24. At step S25, a test alarm electronic message corresponding to a fire element of smoke, heat, or CO for which the test alarm is provided is transmitted at step S25 to the fire receiver 10.

Subsequently at step S26, reception of a light-ON control electronic message from the fire receiver 10 is sensed, the control proceeds to step S27. At step S27, when a smoke test alarm is determined, the control proceeds to step S28 to perform display control of periodically repeating one-time blinking of the alarm indicating lights 30 and displaying a test alarm by smoke sensing.

Also, when a heat test alarm is determined at step S29, the control proceeds to step S30 to perform display control of periodically repeating two-time blinking of the alarm indicating lights 30 and displaying a test alarm by heat sensing. Also, when a CO test alarm is determined at step S31, the control proceeds to step S32 to perform display control of periodically repeating three-time blinking of the alarm indicating lights 30 and displaying a test alarm by CO sensing.

Subsequently, when a next test alarm is sensed at step S33 of FIG. 10, a test alarm electronic message is transmitted at step S34. In this case, since a light-ON control electronic message has already been received at step S26, the control proceeds to step S35. When a smoke test alarm is determined, the control proceeds to step S36 to perform display control of periodically repeating one-time blinking of the alarm indicating lights 30 and displaying a test alarm by smoke sensing.

Also, when a heat test alarm is determined at step S37, the control proceeds to step S38 to perform display control of periodically repeating two-time blinking of the alarm indicating lights 30 and displaying a test alarm by heat sensing. Also, when a CO test alarm is determined at step S39, the control proceeds to step S40 to perform display control of periodically repeating three-time blinking of the alarm indicating lights 30 and displaying a test alarm by CO sensing.

Subsequently, until reception of a light-OFF control electronic message is sensed at step S41, the control skips step S42 to proceed to step S43. Until reception of a test end electronic message is sensed at step S43, the control repeats the process from step S33.

When reception of a light-OFF control electronic message is sensed at step S41, the control proceeds to step S42 to stop light-ON control of the alarm indicating lights 30. Also, when reception of a test end electronic message is sensed at step S43, the control proceeds to step S44 to clear the test mode, and returns to monitoring of smoke, heat, and CO in normal mode at step S21.

(Another Embodiment of Fire Receiver Control)

FIG. 11 is a flowchart depicting fire receiver control operation according to another embodiment. In FIG. 11, step S1 to S8 and steps S12 to 14 are identical to the control operation of FIG. 8, but FIG. 11 is characterized in that a process of step S81 is provided in place of steps S9 to S11 of FIG. 8.

That is, in the control operation of FIG. 11, an alarm test on a new fire detector is sensed at step S7, and the fire detector providing the test alarm is specified and a light-ON control electronic message is transmitted at step S8. Then at step S81, control is performed such that the fire detector previously providing a test alarm is specified and a light-OFF control electronic message is transmitted.

Thus, when alarm tests are successively conducted on a plurality of fire detectors, as depicted in FIG. 7(B), when an alarm test is conducted on the second fire detector, blinking of the alarm indicating lights 30 of the fire detector 12 emitting a test alarm earliest depicted in FIG. 7(A) stops by the light-OFF control electronic message transmitted from the fire receiver 10. With this, when alarm tests are successively conducted on the plurality of fire detectors 12, only the alarm indicating lights 30 of the fire detector 12 currently providing a test alarm blink as many as times in accordance with the fire element for which the test alarm is provided.

Modification Example of Present Invention

In the above-described embodiments, taken as an example is a test for a fire detector which alarms by sensing of a smoke concentration, heat temperature, and CO concentration as a plurality of fire elements. However, also for a fire detector which alarms by sensing of a smoke concentration and CO concentration, the alarm indicating lights may periodically blink once with a test alarm by smoke sensing, and the alarm indicating lights may periodically blink twice with a test alarm by CO sensing.

Also in the above-described embodiments, the test alarm of the fire detector is performed in the order of smoke, heat, and CO. This order may be any as appropriate. Also, an alarm test for a part of the fire elements may be performed without performing all fire elements, that is, smoke, heat, and CO.

Also, as a test alarm display by sensing of smoke, heat, and CO, other than a display in which the number of times of periodical blinking of the alarm indicating lights is changed, an appropriate display mode can be taken as long as the display mode is varied, such as the light-ON time is changed or the display color of the LEDs is changed.

Also, while the alarm tests are conducted by specifying all fire detectors connected to the transmission path in the above-described alarm test on the fire detectors, the security zone where the fire detectors are installed may be divided into a plurality of zones and a fire detector may be specified for each zone to conduct an alarm test, or a fire test may be conducted by specifying in units of any number of fire detectors.

Also, the number of types is not limited to three including smoke, heat, CO, and the fire detector may sense fire elements of many types.

Also, the present invention includes appropriate modifications not impairing its purpose and advantage, and is further not limited by the numerical values described in the above-described embodiments.

DESCRIPTION OF REFERENCE NUMERALS

10: fire receiver
12: fire detector
16: transmission path
18: reception control unit
20, 66: transmitting unit
22: display unit
24: operating unit
26: alert unit
28: transfer unit
30: alarm indicating light
32: cover
54: light-emitting unit
56: light receiving unit
62: detector control unit
70: temperature sensor
74: CO sensor
80: display drive unit
84: test jig

The invention claimed is:

1. A fire notification system comprising:

a fire detector which detects a plurality of fire elements including at least two types among a heat temperature, a smoke concentration, and a gas concentration;

a transmission path;

a fire receiver, connected to the fire detector via the transmission path, the fire receiver including a reception control unit which sets the fire detector to a detector test mode for a test operation in which a test jig is used to conduct alarm tests by sensing of the plurality of fire elements, wherein the fire detector includes:

an alarm indicating light that can be displayed in plural modes, wherein in the plural modes the alarm indicating light displays a different display light, respectively, and a detector control unit which, in the detector test mode controls the alarm indicating light to display a different one of the plural modes in correspondence with detection by the fire detector of each of the plurality of fire elements, respectively;

wherein the reception control unit of the fire receiver counts a number of fire detectors that are controlling the alarm indicating light by a test alarm every time a test alarm electronic message is received from a new fire detector, and the reception control unit of the fire receiver transmits a light-OFF control electronic message, which specifies a fire detector that is the earliest to control the alarm indicating light and that is of the number of fire detectors that are controlling the alarm indicating light, when the number of fire detectors reaches a predetermined number, and wherein the detector control unit of the fire detector stops the fire detector that is the earliest to control the alarm indicating light from controlling the alarm indicating light when receiving the light-OFF control electronic message from the fire receiver.

2. The fire notification system according to claim 1, wherein the reception control unit of the fire receiver sets a receiver test mode and also transmits a test start electronic message to the fire detector when sensing the test operation, wherein the fire detector, in the detector test mode, transmits a test alarm electronic message, wherein the reception control unit of the fire receiver transmits a light-ON control electronic message to the fire detector transmitting the test alarm electronic message, when receiving the test alarm electronic message from the fire detector set in the detector test mode, and wherein the reception control unit of the fire receiver transmits a test end electronic message to a plurality of specified fire detectors and clears settings of the receiver test mode when sensing a test end operation, and wherein the detector control unit of the fire detector sets the detector test mode when receiving the test start electronic message from the fire receiver, transmits the test alarm electronic message to the fire receiver when sensing the test operation in a state where the detector test mode is set, controls the alarm indicating light to display the different one of the plural modes in correspondence with detection by the fire detector of each of the plurality of fire elements, respectively, when receiving the light-ON control electronic message from the fire receiver, and clears the detector test mode when receiving the test end electronic message from the fire receiver.

3. The fire notification system according to claim 2, wherein the reception control unit of the fire receiver transmits a light-OFF control electronic message that specifies a fire detector that is controlling the alarm indicating light by a previous test alarm, when receiving the test alarm electronic message from a new fire detector, and wherein the detector control unit of the fire detector stops the control of the alarm indicating light when receiving the light-OFF control electronic message from the fire receiver.

4. The fire notification system according to claim 2, wherein the detector control unit of the fire detector varies a number of times of blinking of the alarm indicating light in accordance with the plurality of fire elements at a time of a test alarm.

5. The fire notification system according to claim 2, wherein the detector control unit of the fire detector causes the alarm indicating light to blink once or a plurality of times in accordance with a test alarm, and then repeats the blinking at intervals of a predetermined pause period.

6. The fire notification system according to claim 5, wherein the detector control unit of the fire detector causes the alarm indicating light to perform one-time blinking, two-time blinking, or three-time blinking at a predetermined blinking period in accordance with the test alarm by sensing of the heat temperature, sensing of the smoke concentration, or sensing of the gas concentration, and then to repeat the one-time blinking, the two-time blinking, or the three-time blinking at the intervals of the predetermined pause period.

7. The fire notification system according to claim 1, wherein the fire detector is provided with one or plurality of LEDs as the alarm indicating light.

8. A testing method using a test jig for a fire notification system including a fire detector, a transmission path and a fire receiver connected to the fire detector via the transmission path, the fire detector is operable to detect a plurality of fire elements including at least two types among a heat temperature, a smoke concentration, and a gas concentration, said testing method comprising:

setting, via the fire receiver, a detector test mode to the fire detector when sensing a test operation in which a test jig is used to conduct alarm tests by sensing of the plurality of fire elements;

controlling, via the fire detector, which includes an alarm indicating light that can be displayed in different modes, wherein the different modes are configured to display various lights, the alarm indicating light to display a different one of the plural modes in correspondence with detection by the fire detector of each of the plurality of fire elements, respectively;

counting, via the fire receiver, a number of fire detectors controlling the alarm indicating light by a test alarm every time a test alarm electronic message is received from a new fire detector;

transmitting, via the fire receiver, a light-OFF control electronic message, which specifies a fire detector that is the earliest to control the alarm indicating light and that is of the number of fire detectors that are controlling the alarm indicating light, when the number of fire detectors reaches a predetermined number; and stopping the fire detector that is the earliest to control the alarm indicating light from controlling the alarm indicating light when receiving the light-OFF control electronic message from the fire receiver.

9. The testing method using the test jig for the fire notification system according to claim 8, further comprising:

setting, via the fire receiver, a receiver test mode and also transmitting a test start electronic message to the fire detector when sensing the test operation, wherein the fire detector sets the detector test mode when receiving the test start electronic message from the fire receiver, and transmits a test alarm electronic message to the fire receiver when sensing the test operation by sensing of the plurality of fire elements when the detector test mode is set, wherein the fire receiver transmits a light-ON control electronic message to the fire detector transmitting the test alarm electronic message, when receiving the test alarm electronic message from the fire detector set in the detector test mode, wherein the fire detector, transmitting the test alarm electronic message, controls the alarm indicating light to display a different one of the plural modes in correspondence with detection by the fire detector of each of the plurality of fire elements, respectively, when receiving the light-ON control electronic message, wherein the fire receiver transmits a test end electronic message to a plurality of specified fire detectors and clears the setting of the receiver test mode, when sensing a test end operation, and wherein the fire detector clears the detector test mode when receiving the test end electronic message from the fire receiver.

10. The testing method using the test jig for the fire notification system according to claim 9, further comprising:

transmitting, via the fire receiver, a light-OFF control electronic message that specifies a fire detector that is controlling the alarm indicating light by a previous test alarm when receiving the test alarm electronic message from a new fire detector; and stopping the fire detector, which is controlling the alarm indicating light by a test alarm, from controlling the alarm indicating light when receiving the light-OFF control electronic message from the fire receiver.

11. The testing method using the test jig for the fire notification system according to claim 9, further comprising varying, via the fire detector, a number of times of blinking of the alarm indicating light in accordance with the plurality of fire elements at a time of a test alarm.

12. The testing method using the test jig for the fire notification system according to claim 9, further comprising causing, via the fire detector, the alarm indicating light to blink once or a plurality of times in accordance with a test alarm, and then to repeat the blinking at intervals of a predetermined pause period.

13. The testing method using the test jig for the fire notification system according to claim 12, further comprising causing, via the fire detector, the alarm indicating light to perform one-time blinking, two-time blinking, or three-time blinking at a predetermined blinking period in accordance with the test alarm by sensing of the heat temperature, sensing of the smoke concentration, or sensing of the gas concentration and then to repeat the one-time blinking, the two-time blinking, or the three-time blinking at the intervals of the predetermined pause period.

14. The testing method using the test jig for the fire notification system according to claim 8, wherein the fire detector is provided with one or plurality of LEDs as the alarm indicating light.

* * * * *